US009723393B2

(12) United States Patent
Nguyen et al.

(10) Patent No.: US 9,723,393 B2
(45) Date of Patent: Aug. 1, 2017

(54) METHODS TO CONSERVE REMOTE BATTERIES

(71) Applicant: EchoStar Technologies L.L.C., Englewood, CO (US)

(72) Inventors: Phuc H. Nguyen, Parker, CO (US); Christopher William Bruhn, Aurora, CO (US)

(73) Assignee: EchoStar Technologies L.L.C., Englewood, CO (US)

( * ) Notice: Subject to any disclaimer, the term of this patent is extended or adjusted under 35 U.S.C. 154(b) by 119 days.

(21) Appl. No.: 14/229,684

(22) Filed: Mar. 28, 2014

(65) Prior Publication Data

US 2015/0281824 A1 Oct. 1, 2015

(51) Int. Cl.
*H04R 1/10* (2006.01)
*H04R 5/033* (2006.01)

(52) U.S. Cl.
CPC ..... *H04R 1/1041* (2013.01); *H04R 5/033* (2013.01); *H04R 2420/07* (2013.01); *H04R 2460/03* (2013.01)

(58) Field of Classification Search
CPC .... H04R 1/1041; H04R 2420/07; H04R 1/10; H04R 1/1091; H04R 1/1008; H04R 1/1016; H04M 1/6066; H04M 2250/12; H04B 2001/3866; H04W 52/0251; H04W 52/0254; H04W 52/0258; H04N 5/63; H04N 21/4436; H04N 21/42201; G06F 3/01; G06F 3/011; G06F 3/012; G06F 1/3218; G06F 1/3231; G06F 1/3203; G06F 1/3215; G06F 1/32; G06F 1/3246; G06F 3/013; G06F 3/015; Y02B 70/16
USPC ..... 381/74; 455/575.2, 575.1, 574, 420; 379/106.02, 428.02; 345/156, 158, 169
See application file for complete search history.

(56) References Cited

U.S. PATENT DOCUMENTS

| | | | |
|---|---|---|---|
| 4,386,436 | A | 5/1983 | Kocher et al. |
| 4,581,606 | A | 4/1986 | Mallory |
| 4,728,949 | A | 3/1988 | Platte et al. |
| 4,959,713 | A | 9/1990 | Morotomi et al. |
| 5,400,246 | A | 3/1995 | Wilson et al. |
| 5,770,896 | A | 6/1998 | Nakajima |
| 5,805,442 | A | 9/1998 | Crater et al. |

(Continued)

FOREIGN PATENT DOCUMENTS

| | | | |
|---|---|---|---|
| CA | 2267988 | A1 | 4/1998 |
| CN | 105814555 | A | 7/2016 |

(Continued)

OTHER PUBLICATIONS

U.S. Appl. No. 13/910,804, filed Jun. 5, 2013 (44 pgs.).

(Continued)

*Primary Examiner* — Vivian Chin
*Assistant Examiner* — Jason R Kurr
(74) *Attorney, Agent, or Firm* — Seed Intellectual Property Law Group LLP

(57) ABSTRACT

A wireless headset receives audio data wirelessly from a television receiver and outputs audio to the user through earphones. The wireless headset includes an inertial sensor that detects an orientation of the user's head. If the orientation of the user's head indicates that the user is sleeping, then wireless headset turns off the wireless receiver, thereby saving battery life.

20 Claims, 8 Drawing Sheets

(56) References Cited

U.S. PATENT DOCUMENTS 5,822,012 A 10/1998 Jeon et al.
5,894,331 A * 4/1999 Yang ..... H04N 5/44513 348/581
5,926,090 A 7/1999 Taylor et al.
5,970,030 A 10/1999 Dimitri et al.
6,081,758 A 6/2000 Parvulescu
6,104,334 A 8/2000 Allport
6,107,918 A 8/2000 Klein et al.
6,107,935 A 8/2000 Comerford et al.
6,119,088 A 9/2000 Ciluffo
6,182,094 B1 1/2001 Humpleman et al.
6,330,621 B1 12/2001 Bakke et al.
6,337,899 B1 1/2002 Alcendor et al.
6,377,858 B1 4/2002 Koeppe
6,405,284 B1 6/2002 Bridge
6,415,257 B1 7/2002 Junqua et al.
6,502,166 B1 12/2002 Cassidy
6,529,230 B1 3/2003 Chong
6,553,375 B1 4/2003 Huang et al.
6,646,676 B1 11/2003 DaGraca et al.
6,662,282 B2 12/2003 Cochran
6,663,375 B1 12/2003 Ulcej
6,756,998 B1 6/2004 Bilger
6,931,104 B1 8/2005 Foster et al.
6,976,187 B2 12/2005 Arnott et al.
6,989,731 B1 1/2006 Kawai et al.
7,009,528 B2 3/2006 Griep
7,010,332 B1 * 3/2006 Irvin ..... H04M 1/05 379/106.02
7,103,545 B2 9/2006 Furuta
7,143,298 B2 11/2006 Wells et al.
7,234,074 B2 6/2007 Cohn et al.
7,260,538 B2 8/2007 Calderone et al.
7,346,917 B2 3/2008 Gatto et al.
7,372,370 B2 5/2008 Stults et al.
7,386,666 B1 6/2008 Beauchamp et al.
7,395,369 B2 7/2008 Sepez et al.
7,395,546 B1 7/2008 Asmussen
7,529,677 B1 5/2009 Wittenberg
7,574,494 B1 8/2009 Mayernick et al.
7,590,703 B2 9/2009 Cashman et al.
7,640,351 B2 12/2009 Reckamp et al.
7,694,005 B2 4/2010 Reckamp et al.
7,739,718 B1 6/2010 Young et al.
7,861,034 B2 12/2010 Yamamoto et al.
7,870,232 B2 1/2011 Reckamp et al.
7,945,297 B2 * 5/2011 Philipp ..... H04R 1/1041 455/557
7,969,318 B2 6/2011 White et al.
8,013,730 B2 9/2011 Oh et al.
8,086,757 B2 12/2011 Chang
8,106,768 B2 1/2012 Neumann
8,156,368 B2 4/2012 Chambliss et al.
8,171,148 B2 5/2012 Lucas et al.
8,180,735 B2 5/2012 Ansari et al.
8,201,261 B2 6/2012 Barfield et al.
8,221,290 B2 7/2012 Vincent et al.
8,275,143 B2 * 9/2012 Johnson ..... H04R 1/1025 381/371
8,289,157 B2 10/2012 Patenaude et al.
8,290,545 B2 * 10/2012 Terlizzi ..... H04M 1/05 367/118
8,310,335 B2 11/2012 Sivakkolundhu
8,320,578 B2 * 11/2012 Kahn ..... H04M 1/6066 381/123
8,335,312 B2 * 12/2012 Gerhardt ..... H04M 1/6066 379/430
8,498,572 B1 7/2013 Schooley et al.
8,550,368 B2 10/2013 Butler et al.
8,619,136 B2 12/2013 Howarter et al.
8,644,525 B2 2/2014 Bathurst et al.
8,645,327 B2 2/2014 Falkenburg et al.
8,667,529 B2 3/2014 Taxier
8,750,576 B2 6/2014 Huang et al.
8,780,201 B1 7/2014 Scalisi et al.
8,786,698 B2 * 7/2014 Chen ..... G06F 3/011 348/135
8,799,413 B2 8/2014 Taylor et al.
8,930,700 B2 1/2015 Wielopolski
8,965,170 B1 2/2015 Benea et al.
9,019,111 B1 4/2015 Sloo et al.
9,049,567 B2 6/2015 Le Guen et al.
9,246,921 B1 1/2016 Vlaminck et al.
9,462,041 B1 10/2016 Hagins et al.
2001/0012998 A1 8/2001 Jouet et al.
2002/0019725 A1 2/2002 Petite
2002/0063633 A1 5/2002 Park
2002/0080238 A1 6/2002 Ohmura
2002/0193989 A1 12/2002 Geilhufe et al.
2003/0005431 A1 1/2003 Shinohara
2003/0052789 A1 * 3/2003 Colmenarez ..... G06K 9/00771 340/575
2003/0097452 A1 5/2003 Kim et al.
2003/0126593 A1 7/2003 Mault
2003/0133551 A1 7/2003 Kahn
2003/0140352 A1 7/2003 Kim
2003/0201900 A1 10/2003 Bachinski et al.
2004/0019489 A1 1/2004 Funk et al.
2004/0117038 A1 6/2004 Karaoguz et al.
2004/0117843 A1 6/2004 Karaoguz et al.
2004/0121725 A1 6/2004 Matsui
2004/0128034 A1 7/2004 Lenker et al.
2004/0143838 A1 7/2004 Rose
2004/0148419 A1 7/2004 Chen et al.
2004/0148632 A1 7/2004 Park et al.
2004/0260407 A1 12/2004 Wimsatt
2004/0266419 A1 12/2004 Arling et al.
2005/0038875 A1 2/2005 Park
2005/0049862 A1 3/2005 Choi et al.
2005/0188315 A1 8/2005 Campbell et al.
2005/0200478 A1 9/2005 Koch et al.
2005/0245292 A1 * 11/2005 Bennett ..... H04B 1/1615 455/574
2005/0264698 A1 12/2005 Eshleman
2005/0289614 A1 12/2005 Baek et al.
2006/0011145 A1 1/2006 Kates
2006/0087428 A1 4/2006 Wolfe et al.
2006/0136968 A1 6/2006 Han et al.
2006/0143679 A1 6/2006 Yamada et al.
2006/0155389 A1 * 7/2006 Pessolano ..... H04N 5/63 700/12
2007/0044119 A1 2/2007 Sullivan et al.
2007/0078910 A1 4/2007 Bopardikar
2007/0129220 A1 6/2007 Bardha
2007/0135225 A1 6/2007 Nieminen et al.
2007/0142022 A1 6/2007 Madonna et al.
2007/0146545 A1 6/2007 Iwahashi
2007/0157258 A1 7/2007 Jung et al.
2007/0192486 A1 8/2007 Wilson et al.
2007/0256085 A1 11/2007 Reckamp et al.
2007/0271518 A1 11/2007 Tischer et al.
2007/0275670 A1 11/2007 Chen et al.
2008/0021971 A1 1/2008 Halgas
2008/0022322 A1 1/2008 Grannan et al.
2008/0062258 A1 3/2008 Bentkovski et al.
2008/0062965 A1 3/2008 Silva et al.
2008/0109095 A1 5/2008 Braithwaite et al.
2008/0114963 A1 5/2008 Cannon et al.
2008/0123825 A1 5/2008 Abramson et al.
2008/0140736 A1 6/2008 Jarno
2008/0163330 A1 7/2008 Sparrell
2008/0278635 A1 11/2008 Hardacker et al.
2008/0284905 A1 11/2008 Chuang
2008/0288876 A1 11/2008 Fleming
2008/0297660 A1 12/2008 Shioya
2009/0023554 A1 1/2009 Shim
2009/0069038 A1 3/2009 Olague et al.
2009/0112541 A1 4/2009 Anderson et al.
2009/0138507 A1 5/2009 Burckart et al.
2009/0146834 A1 6/2009 Huang
2009/0165069 A1 6/2009 Kirchner
2009/0167555 A1 7/2009 Kohanek
2009/0190040 A1 7/2009 Watanabe et al.

(56) References Cited

U.S. PATENT DOCUMENTS

2009/0249428 A1 10/2009 White et al.
2009/0271203 A1 10/2009 Resch et al.
2010/0031286 A1* 2/2010 Gupta ..... H04N 5/44543 725/38
2010/0046918 A1 2/2010 Takao et al.
2010/0083371 A1 4/2010 Bennetts et al.
2010/0097225 A1 4/2010 Petricoin, Jr.
2010/0107184 A1* 4/2010 Shintani ..... H04N 21/4436 725/10
2010/0122284 A1 5/2010 Yoon et al.
2010/0131280 A1 5/2010 Bogineni
2010/0138007 A1 6/2010 Clark et al.
2010/0138858 A1 6/2010 Velazquez et al.
2010/0146445 A1 6/2010 Kraut
2010/0211546 A1 8/2010 Grohman et al.
2010/0283579 A1 11/2010 Kraus et al.
2010/0321151 A1 12/2010 Matsuura et al.
2011/0030016 A1 2/2011 Pino, Jr. et al.
2011/0032423 A1 2/2011 Jing et al.
2011/0093126 A1 4/2011 Toba et al.
2011/0119325 A1 5/2011 Paul et al.
2011/0150432 A1 6/2011 Paul et al.
2011/0156862 A1 6/2011 Langer
2011/0187928 A1 8/2011 Crabtree
2011/0187930 A1 8/2011 Crabtree
2011/0187931 A1 8/2011 Kim
2011/0202956 A1 8/2011 Connelly et al.
2011/0270549 A1 11/2011 Jeansonne et al.
2011/0282837 A1 11/2011 Gounares et al.
2011/0283311 A1 11/2011 Luong
2011/0295396 A1 12/2011 Chinen et al.
2012/0019388 A1 1/2012 Kates
2012/0047532 A1 2/2012 McCarthy, III
2012/0059495 A1 3/2012 Weiss et al.
2012/0069246 A1 3/2012 Thornberry et al.
2012/0094696 A1 4/2012 Ahn et al.
2012/0124456 A1 5/2012 Perez et al.
2012/0154108 A1 6/2012 Sugaya
2012/0271670 A1 10/2012 Zaloom
2012/0280802 A1 11/2012 Yoshida et al.
2012/0291068 A1 11/2012 Khushoo et al.
2012/0316876 A1 12/2012 Jang et al.
2012/0326835 A1 12/2012 Cockrell et al.
2013/0046800 A1 2/2013 Assi et al.
2013/0053063 A1 2/2013 McSheffrey
2013/0060358 A1 3/2013 Li et al.
2013/0070044 A1 3/2013 Naidoo et al.
2013/0074061 A1 3/2013 Averbuch et al.
2013/0090213 A1 4/2013 Amini et al.
2013/0124192 A1 5/2013 Lindmark et al.
2013/0138757 A1 5/2013 Ferron
2013/0152139 A1 6/2013 Davis et al.
2013/0204408 A1 8/2013 Thiruvengada et al.
2013/0267383 A1 10/2013 Watterson
2013/0300576 A1 11/2013 Sinsuan et al.
2013/0318559 A1 11/2013 Crabtree
2013/0321637 A1 12/2013 Frank et al.
2013/0324247 A1 12/2013 Esaki et al.
2014/0028546 A1* 1/2014 Jeon ..... G06F 3/014 345/156
2014/0095684 A1 4/2014 Nonaka et al.
2014/0101465 A1 4/2014 Wang et al.
2014/0142724 A1 5/2014 Park et al.
2014/0160360 A1 6/2014 Hsu et al.
2014/0168277 A1 6/2014 Ashley et al.
2014/0192197 A1 7/2014 Hanko et al.
2014/0192997 A1 7/2014 Niu et al.
2014/0215505 A1 7/2014 Balasubramanian et al.
2014/0218517 A1 8/2014 Kim et al.
2014/0266669 A1 9/2014 Fadell et al.
2014/0266684 A1 9/2014 Poder et al.
2014/0310075 A1 10/2014 Ricci
2014/0333529 A1* 11/2014 Kim ..... G06F 3/015 345/156
2014/0351832 A1 11/2014 Cho et al.
2014/0373074 A1 12/2014 Hwang et al.
2015/0029087 A1* 1/2015 Klappert ..... G06F 3/015 345/156
2015/0029096 A1* 1/2015 Ishihara ..... H04N 5/63 345/156
2015/0054910 A1 2/2015 Offen et al.
2015/0061859 A1 3/2015 Matsuoka et al.
2015/0066173 A1 3/2015 Ellis et al.
2015/0084770 A1 3/2015 Xiao et al.
2015/0106866 A1 4/2015 Fujita
2015/0127712 A1 5/2015 Fadell et al.
2015/0143406 A1 5/2015 Cho et al.
2015/0143408 A1 5/2015 Sallas
2015/0145643 A1 5/2015 Fadell et al.
2015/0154850 A1 6/2015 Fadell et al.
2015/0156030 A1 6/2015 Fadell et al.
2015/0156612 A1 6/2015 Vemulapalli
2015/0159401 A1 6/2015 Patrick et al.
2015/0160623 A1 6/2015 Holley
2015/0160634 A1 6/2015 Smith et al.
2015/0160635 A1 6/2015 Schofield et al.
2015/0160636 A1 6/2015 McCarthy, III et al.
2015/0160663 A1 6/2015 McCarthy, III et al.
2015/0160935 A1 6/2015 Nye
2015/0161452 A1 6/2015 McCarthy, III et al.
2015/0161882 A1 6/2015 Lett
2015/0162006 A1 6/2015 Kummer
2015/0163411 A1 6/2015 McCarthy, III et al.
2015/0163412 A1 6/2015 Holley et al.
2015/0163535 A1 6/2015 McCarthy, III et al.
2015/0172742 A1 6/2015 Richardson
2015/0192914 A1 7/2015 Slupik
2015/0198941 A1 7/2015 Pederson
2015/0208125 A1* 7/2015 Robinson ..... H04N 21/4223 725/12
2015/0309487 A1 10/2015 Lyman
2015/0341599 A1 11/2015 Carey
2015/0347910 A1 12/2015 Fadell et al.
2016/0063854 A1 3/2016 Burton et al.
2016/0066046 A1 3/2016 Mountain
2016/0091471 A1 3/2016 Benn
2016/0100696 A1 4/2016 Palashewski et al.
2016/0109864 A1 4/2016 Lonn
2016/0121161 A1 5/2016 Mountain
2016/0123741 A1 5/2016 Mountain
2016/0163168 A1 6/2016 Brav et al.
2016/0182249 A1 6/2016 Lea
2016/0191912 A1 6/2016 Lea et al.
2016/0191990 A1 6/2016 McCarthy, III
2016/0203700 A1 7/2016 Bruhn et al.
2016/0234034 A1 8/2016 Mahar et al.
2016/0260135 A1 9/2016 Zomet et al.
2016/0286327 A1 9/2016 Marten
2016/0334811 A1 11/2016 Marten
2016/0335423 A1 11/2016 Beals
2016/0342379 A1 11/2016 Keipert et al.

FOREIGN PATENT DOCUMENTS

EP 2 736 027 A1 5/2014
GB 2 304 952 A 3/1997
JP 2008-148016 A 6/2008
WO 93/20544 A1 10/1993
WO 2004/068386 A1 8/2004
WO 2011/095567 A1 8/2011
WO 2014/068556 A1 5/2014
WO 2015/088603 A1 6/2015
WO 2015/088608 A1 6/2015
WO 2016/034880 A1 3/2016
WO 2016/066399 A1 5/2016
WO 2016/066442 A1 5/2016
WO 2016/182696 A1 11/2016

OTHER PUBLICATIONS

Allseen Alliance, "AllJoyn™ Onboarding Framework," URL=http://allseenalliance.org/framework/documentation/learn/base-services/onboarding, download date Mar. 13, 2017, 8 pages.

(56) References Cited

OTHER PUBLICATIONS

Amulet Devices, "Voice Activated TV using the Amulet Remote for Media Center," URL=http://www.amuletdevices.com/index.php/Features/television.html, download date Mar. 13, 2017, 1 page.
Bravedo.com, "Do you want to know how to find water leaks?," URL=http://bravedo.com, download date Mar. 13, 2017, 10 pages.
Cheng et al., "A Wireless Sensor System for Prognostics and Health Management," *IEEE Sensors Journal 10*(4):856-862, 2010.
Crestron, "Control App for Samsung Smart TV®," Aug. 2014, URL=www.crestron.com/downloads/pdf/product_misc/qs_crestron-app-sstv.pdf, download date Mar. 13, 2017, 3 pages.
Flood, "Acoustic/Ultrasound Ultrasonic Flowmeter Basics," Oct. 1, 1997, URL=http://www.sensorsmag.com/sensors/acoustic-ultrasound/ultrasonic-flowmeter-basics-842, download date Mar. 13, 2017, 5 pages.
Fong et al., "Indoor Air Quality Control for Asthma Patients Using Smart Home Technology," *IEEE 15th International Symposium on Consumer Electronics*, Singapore, Singapore, Jun. 14-17, 2011, pp. 18-19.
LaMonica, "CES 2010 preview: Green comes in many colors," Dec. 22, 2009, URL=https://www.cnet.com/news/ces-2010-preview-green-comes-in-many-colors/, download date Mar. 13, 2017, 2 pages.
Mitchell, "Addison Fire Department Access Control Installation," *2012 International Fire Code Section 1008.1.9.8*, URL=https://addisontexas.net/ckeditorfiles/files/forms/Fire%20Department/Fire_Prevention_files/2015-Addison-Access-Control-Installation-Requirements.pdf, download date Mar. 13, 2017, 2 pages.
Omega, "Ultrasonic Flowmeters," URL=http://www.omega.com/prodinfo/ultrasonicflowmeters.html, download date Mar. 13, 2017, 2 pages.
Pulsar Process Measurement, "Flow Pulse®: Non-invasive clamp-on flow monitor for pipes," URL=https://www.pulsar-pm.com/product-types/flow/flow-pulse.aspx, download date Mar. 13, 2017, 5 pages.
RSHydro, "Ultrasonic Flow Meters," URL=http://www.rshydro.co.uk/flow-meters/ultrasonic-flow-meters/, download date Mar. 13, 2017, 6 pages.
Securitron, "International Building Code Excerpts: Updated with Recent Code Changes that Impact Electromagnetic Locks," URL=http://accesshardware.com/wp-content/uploads/2014/08/IBC-IFC-Access-Controlled-Egress-Doors.pdf, download date Mar. 13, 2017, 2 pages.
Wang et al., "Mixed Sound Event Verification on Wireless Sensor Network for Home Automation," *IEEE Transactions on Industrial Informatics 10*(1):803-812, 2014.

* cited by examiner

METHODS TO CONSERVE REMOTE BATTERIES

BACKGROUND

Technical Field

The present disclosure relates to the use of streaming audio data to a wireless headset. The present disclosure relates, more particularly, to conserving the battery life of a wireless headset streaming audio data.

Description of the Related Art

Media programs such as television programming, movies, video games, etc. typically include a video portion and an audio portion. The video portion of the media programs is commonly displayed on a television or computer monitor. The audio portion of the media programs is commonly output from speakers connected to the television or monitor, or from a home entertainment sound system including a large arrangement of speakers. However, it has become increasingly common for users to receive the audio portion of a media program through the headphones of a wireless headset. The wireless headset receives the audio portion of the media program wirelessly from a television receiver, a game console, a DVD player, stereo system, etc. The wireless headset reproduces the audio portion for the user via the earphones of the wireless headset.

Wireless headsets are typically powered by a battery or batteries. A comparatively large amount of power is consumed by the wireless headset when the wireless transceiver, which receives the audio portion of the media program, is active. There are many instances in which the wireless transceiver of the wireless headset continues to function when the user is no longer listening. This consumes battery power and causes the user to need to replace or recharge batteries more frequently than desired.

BRIEF SUMMARY

One embodiment is a television receiver that transmits the audio portion of a media program to a wireless headset worn by a user. The television receiver is configured to receive user input indicating that after a particular media program or at a particular time, the television receiver should transmit a command to the wireless headset that causes the wireless headset to turn off. Thus, when a particular media program has ended, or when a particular time has arrived, the television receiver transmits a command to the wireless headset causing the wireless headset to turn off. In this way, if a user intends to watch a media program and plans to fall asleep during the program or plans to go to bed after the program, the wireless headset will not needlessly consume batteries long after the user has stopped using the wireless headset.

One embodiment is a wireless headset that is configured to receive the audio portion of the media program from a television receiver or another media device. The wireless headset includes a sensor that monitors a physical trait of the user. If the physical trait of the user indicates that the user has fallen asleep, then the wireless headset turns off. In one embodiment the sensor includes an inertial sensor that detects the movements of the user's head. If the movements of the user's head indicates that the user is asleep, then the wireless headset turns off. Alternatively, the inertial sensor can detect the orientation of the user's head, for example whether the user's head is upright or tilted to one side. If the orientation of the user's head indicates that the user is asleep, then the wireless headset turns off.

In one embodiment the monitoring and sending of commands is done by the television receiver or other media device that is configured to transmit an audio portion of the media program to the wireless headset.

In one embodiment, the sensor includes a camera that monitors the user's eyes to see if they are closed for a prolonged period of time. In one embodiment the camera monitors the orientation of the user's head to detect if the orientation of the user's head indicates that the user has fallen asleep.

DETAILED DESCRIPTION

Figure 1:
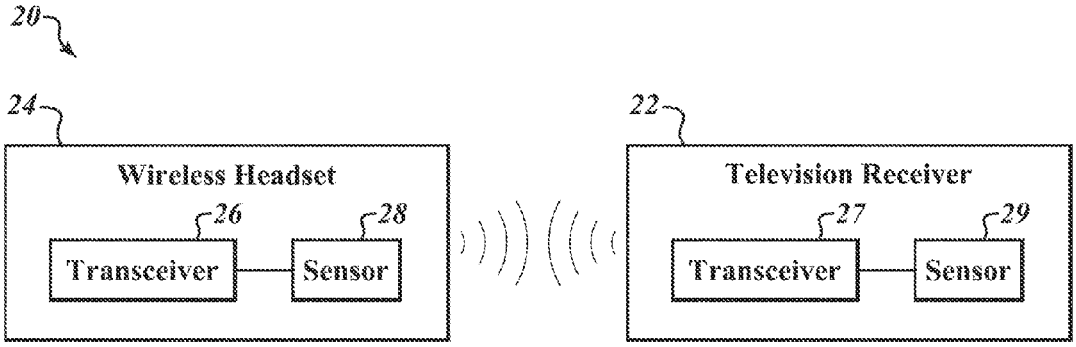
FIG. 1 is a block diagram of a system including a television receiver and a wireless headset according to one embodiment.

FIG. 1 is a block diagram of a system 20 including a television receiver 22 and a wireless headset 24. The wireless headset 24 includes a transceiver 26 and a sensor 28.

The television receiver 22 receives media content from a television programming distributor such as a cable television distributor, satellite television distributor, an Internet television distributor, or a terrestrial broadcast television distributor. The media content includes media programs such as television programs, movies, pay-per-view movies, radio programs, or other types of media content.

The television receiver 22 typically displays the video portion of a media program on a display coupled to the television receiver 22. The television receiver 22 outputs an audio portion of the media program to the wireless headset 24 worn by a user. In particular, the television receiver 22 wirelessly transmits a signal including the audio portion of the media program to the wireless headset 24. The transceiver 26 of a wireless headset 24 receives the signal from the television receiver 22 and outputs the audio portion of the media program to headphones of the wireless headset 24.

The wireless headset 24 will typically be powered by batteries. If the batteries become depleted, the wireless headset 24 will become inoperable until the batteries are replaced or recharged. The transceiver 26 of the wireless headset 24 consumes a relatively large amount of energy when it is receiving the audio portion of a media program. To avoid the inconvenience of having to frequently replace rechargeable batteries of the wireless headset 24, the system 20 of FIG. 1 includes functionality designed to reduce the amount of power consumed by the wireless headset, particularly when the user is no longer using the wireless headset or has fallen asleep.

In one embodiment, the television receiver 22 includes an electronic programming guide which can be accessed by the user to view which media programs are available on particular channels at particular times. By operating a remote control, or by utilizing inputs coupled directly to the television receiver 22, the user can access the electronic programming guide and can select a media program to view. When the user selects a media program to view, the user can also enter input directing the television receiver to send a command to the wireless headset 24 to turn off at the end of the selected media program. At the end of the media program, the television receiver 22 will transmit a wireless command signal to the wireless headset 24 directing the wireless headset 24 to enter a reduced power state or to turn off entirely.

This can be of particular use when the user anticipates that he will stop using the wireless headset 24 at the end of the selected media program, or if the user anticipates that he may fall asleep during the media program. In many cases a user plans to stop using the wireless headset at the end of the selected media program, but forgets to turn off the wireless headset 24 or the television receiver 22. This is particularly common in an instance in which the user turns off a television coupled to the television receiver 22, but fails to turn off the television receiver 22. The television receiver 22 may continue to broadcast the audio portion of a subsequent media program to the wireless headset 24. If the user has also forgotten to turn off the wireless headset 24, the transceiver 26 of the wireless headset 24 will continue to operate and receive the audio portion of the subsequent media program. The continued operation of the transceiver 26 will deplete the batteries of the wireless headset 24 even though the user is no longer using the wireless headset 24. When the user returns at a future time to use the wireless headset 24, he may find that the batteries are entirely depleted. It is both inconvenient and expensive to repeatedly recharge the batteries or purchase new batteries.

However, the functionality of the system 20 allows the user to avoid this situation by enabling the user to choose to turn off the wireless headset 24 at the end of a selected media program. Thus, if the user has scheduled the television receiver 22 to turn off the wireless headset 24 at the end of a selected media program, the television receiver 22 will transmit a command to the wireless headset 24 instructing wireless headset 24 to turn off the transceiver 26 or to shut down altogether. If the user then forgets to turn off the wireless headset 24 or the television receiver 22, the wireless headset 24 will nevertheless stop the function of the transceiver 26. In this way the battery life of the wireless headset 24 is not needlessly wasted.

Alternatively, the user of the wireless headset 24 can instruct the television receiver 22 to turn off the wireless headset 24 at a particular time of day. For instance, the user may plan to relax and channel surf at a later time in the evening, without a plan to view any particular media program. Nevertheless the user believes that he will most likely go to bed by midnight. Or, the user can set his planned schedule to be in bed by midnight. The user can thus instruct the television receiver 22 to turn off the wireless headset 24 at midnight. Thus, if the user has gone to bed or if the user has fallen asleep while watching a media program, at midnight the television receiver 22 will transmit a command to the wireless headset 24 causing the wireless headset 24 to turn off the transceiver 26 or to shut down entirely. The user can store a long term, scheduled program to turn off at selected times each day. In this way, the batteries of the wireless headset 24 can be preserved when the user is no longer viewing the media program.

This functionality can also be used by media devices other than a television receiver 22. For example, the wireless headset may receive the audio portion of a media program from a game console, a computer, a tablet, a stereo system, or other kinds of media devices. The functionality described above with respect to the television receiver 22 can also be implemented in these other media devices.

In one example, a user of the wireless headset may be playing a video game and receiving an audio portion of the videogame, as well as audio communication from other players, through the wireless headset 24. The user can schedule the game console or other device to turn off the wireless headset 24 at a particular time or after the user is no longer playing in a particular game. In this way, the wireless headset 24 does not needlessly deplete the batteries after the user is no longer using the wireless headset 24. Those of skill in the art will recognize, in light of the present disclosure, that the energy-saving functionality can be implemented in many other kinds of devices that communicate with a wireless headset 24. All such other devices fall within the scope of the present disclosure.

In one embodiment, the sensor 28 of the wireless headset 24 detects when the user of the wireless headset 24 has fallen asleep. The sensor 28 monitors a physical state of the user and detects whether the user is awake or asleep based on the monitored physical state of the user. When the sensor 28 detects that the user has fallen asleep, the sensor 28 outputs a signal to control circuitry of the wireless headset 24 causing the wireless headset 24 to turn off the transceiver 26 or to shut down altogether.

In one example, the sensor 28 is an inertial sensor that detects the motion of the user's head. Commonly, when a user is awake, the user's head will make particular shifting movements such as nodding, quickly moving to look another direction then moving back, and many other kinds of movements. In contrast, when the user is asleep, the head moves very little or only makes certain kinds of movements particular to a state of sleep. Based on these movements, the sensor 28 can detect whether the user is awake or asleep. If the motion of the user's head, as detected by the sensor 28, indicates that the user is asleep, the sensor 28 can output a signal causing the wireless headset 24 to turn off the transceiver 26 or to shut down altogether.

Alternatively, the sensor 28 can include a microphone that senses the breathing of the user. The breathing pattern of the user can provide an indication of whether the user is asleep or not. When a user falls asleep, the user's breathing pattern changes in a known manner. In particular, the frequency of breathing decreases when a user is asleep. The microphone can detect the users breathing pattern and can determine if the user has fallen asleep based on the breathing pattern. If the microphone determines that the user has fallen asleep, based on the users breathing pattern, the microphone can cause the wireless headset 24 to turn off the transceiver 26 or to shut down altogether.

Sensor 28 can also include a pulse rate monitor that is capable of measuring the heart rate of the user. The heart rate of the user can provide an indication of whether the user has fallen asleep. In particular, when the user falls asleep, the heart rate of the user typically decreases to a level that is significantly lower than the heart rate of the user when the user is awake. If the pulse rate monitor detects that the pulse rate has decreased to a level indicative of the user being asleep, the pulse rate monitor can cause the wireless headset 24 to turn off the transceiver 26 or to shut down altogether.

In one embodiment, when the sensor 28 causes the wireless headset 24 to turn off the radio or to shut down altogether, the wireless headset 24 first transmits a signal to the television receiver 22 indicating that the user is asleep. The television receiver 22 can then enter a low power state while the user is asleep. The low power state can include ceasing transmission of the audio portion to the wireless headset 24 and ceasing transmission of the video portion to the display. The low power state can further include turning off the television receiver 22 altogether. The television receiver 22 can also transfer the shutdown command to the display or to other media devices coupled to the television receiver 22. In this way, when the wireless headset 24 detects that the user has fallen asleep, the wireless headset 24 can also cause other media devices to enter a reduced power state or to shut down altogether, thereby reducing the power consumed by the media devices while the user is asleep.

When the television receiver 22 or other media device receives a signal from the wireless headset 24 indicating that a user is asleep, the television receiver 22 or the media device can take steps to ensure that the user does not miss any portion of the media program that the user is watching. For example, if the user is watching a television program broadcast at a particular time, upon being notified that the user has fallen asleep the television receiver 22 can either pause or automatically record the program to a DVR. The recording can be the remaining portion of the program or going back to record the entire program, which can be done easily since the last few hours of viewed program content are stored in a buffer. In this way, when the user wakes up she can immediately unpause the television program and proceed to watch the remaining portion of the television program or go back to a prior portion that was missed as the user was starting to fall asleep. Alternatively, the user can enter the DVR menu and select to play the remaining portion of the program from among the titles recorded in the DVR. In a similar manner, if the user is watching a movie on DVD or Blu-ray, the DVD or Blu-ray player can immediately cause the DVD or Blu-ray to stop upon being notified by the wireless headset 24 that the user has fallen asleep. Those of skill in the art will recognize that many other actions can be taken by the television receiver or other media devices for the user's convenience upon being notified that the user has fallen asleep.

The sensor 28 can also cause the transceiver 26 of the wireless headset 24 to turn back on when the user wakes up. For example, if the sensor 28 has caused the wireless transceiver 26 to turn off because the sensor 28 has detected that the user has fallen asleep, the sensor 28 can still be in a functioning state and continue to monitor the physical state of the user. If the physical state of the user indicates that the user has woken up, the sensor 28 can cause the transceiver 26 to turn back on and to continue to receive the audio portion of the media program. The wireless headset 24 can also transmit signals to the television receiver 22 or other media devices indicating that the user has woken up. The television receiver 22 or other media devices that have entered a low power mode and/or paused or recorded a media program can immediately resume playing the media program upon notification that the user has woken up. Alternatively, the television receiver 22 or other media device can notify the user that the media program was paused or recorded upon detecting that the user fell asleep. The television receiver 22 or other media device can prompt the user for input regarding whether the user would like to immediately begin playing the paused or recorded program.

In one embodiment, the television receiver 22 includes a sensor 29 that can monitor a physical state of the user. The sensor 29 of the television receiver 22 detects that the user has fallen asleep, the television receiver 22 can transmit a signal via transceiver 27 to the wireless headset 24 indicating that the user has fallen asleep. In response to receiving the signal from the television receiver 22, the wireless headset 24 can enter a low power mode by turning off the transceiver 26 or by shutting down altogether.

In one embodiment, the sensor 29 of the television receiver 22 includes a camera that can monitor the eyes of the user. Sensor 29 can detect if the user's eyes are closed. If the sensor 29 detects that the user's eyes are closed for an extended period of time, then the television receiver 22 determines that the user is asleep. The television receiver 22 then transmits a signal to the wireless headset 24 causing the wireless headset 24 to enter a low power or shutdown mode as described previously. Further details regarding the features of a television receiver 22 or other media device that monitors a user's eyes can be found in U.S. patent application Ser. No. 13/910,804, hereby incorporated by reference in its entirety. Other systems, such as Xbox One and Kinect that are known in the art can also be used.

The television receiver 22 can also monitor and dynamically learn the user's habits/routines and use that information to determine when to automatically power down the wireless headset 24. For example, the television receiver 22 detects that the user commonly watches the evening news and then turns off the television receiver 22 and the wireless headset 24 after the news has ended. On a particular day, the television receiver 22 may detect that the user has not powered down the television receiver 22 and the wireless headset 24 after the conclusion of the evening news. The television receiver can assume that the user might have fallen asleep and that this is the reason for the break from the user's normal routine. The television receiver 22 outputs a prompt on a display indicating that the system 20 will be powered down unless the user provides feedback such as an audible statement command detected by the headset 24 or the television receiver 22, a button press on the wireless headset 24 or on a remote control, etc. If the user does not respond then the wireless headset 24 and the television receiver 22 are powered down.

While many of the features of the system 20 have been described in relation to a television receiver 22 and the wireless headset 24, principles of the present disclosure extend to 3-D glasses or other types of headwear or devices that can be worn by a user in conjunction with viewing media programs. Thus, the 3-D glasses can include the sensor 28 that detects whether the user has fallen asleep and can cause the 3-D glasses to enter into a low power state. Likewise, the television receiver 22 or other media device can transmit a signal to the 3-D glasses causing the 3-D glasses to enter a low power or shutdown state at the end of a selected media program, at a selected time, or upon detecting that the user has fallen asleep.

While a wireless headset 24 has been shown to include a single transceiver 26, those of skill in the art will understand that the wireless headset 24 can include multiple wireless receivers and transmitters. Upon detecting that a user is asleep, the wireless headset 24 may shutdown one or more of the wireless receivers and transmitters while leaving other wireless receivers and transmitters still functioning. For example, in one embodiment the transceiver 26 includes a Bluetooth transceiver that receives the audio portion of the media program. The Bluetooth transceiver can be shutdown when the user falls asleep while other transceivers may still be active. Many configurations of the transceiver 26 are apparent in light of the present disclosure. All such configurations fall within the scope of the present disclosure.

Figure 2:
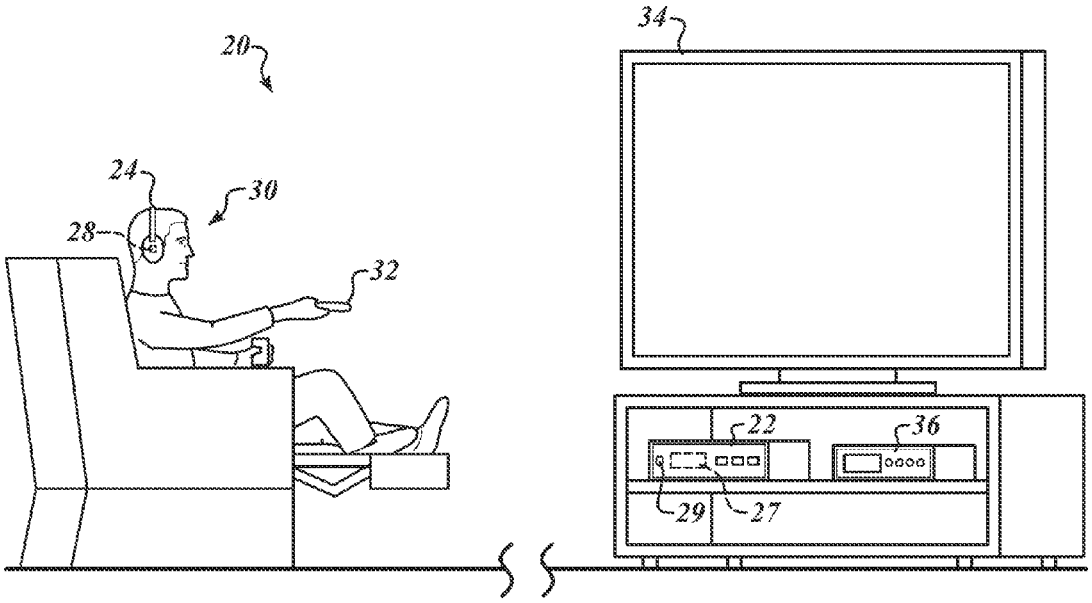
FIG. 2 is an illustration of a residential setting including a user wearing a wireless headset and operating a television receiver according to one embodiment.

FIG. 2 is an illustration of a residential setting including a media presentation system 20 according to one embodiment. The media presentation system 20 includes a television receiver 22, the wireless headset 24 worn by a user 30, a remote control 32 held by the user 30, a television 34 coupled to the television receiver 22, and an electronic media device 36 coupled to the television receiver 22 and the television 34. The wireless headset 24 includes a transceiver 26 and a sensor 28. The television receiver 22 includes a transceiver 27 and a sensor 29.

In one embodiment, the television receiver 22 receives media content from a satellite television service provider, cable television provider, the Internet, terrestrial broadcast signals, etc. The television receiver 22 displays media programs on the television 34. The user 30 can operate a remote control 32 to control the television receiver 22. The user 30 can select media programs to be displayed on a television 34 by the television receiver 22. The audio portion of the media programs are transmitted from the transceiver 27 to the wireless headset 24. The user 30 hears the audio portion of the media program via the headphones of the wireless headset 24.

By using the remote control 32, the user 30 can access menu screens of the television receiver 22. In the menu screens, the user can select a particular media program after which the television receiver 22 should transmit a command to the wireless headset 24 to enter a low power mode or to shut down altogether. For example, the user may wish to watch Sports Center at 10 PM on ESPN. Prior to or during viewing of Sports Center, the user can access the programming guide and can select Sports Center as a final media program to be viewed that night. In this way the user can tell the television receiver 22 to transmit the signal to the wireless headset 24 causing the wireless headset to enter the low power or shutdown mode at the conclusion of the program. In another example, at the end of Sports Center, the television receiver 22 can cease transmitting the audio portion to the wireless headset 24. The wireless headset 24 can preserve power by not actively receiving the audio portion of the broadcast.

Alternatively, from the menu screens of the television receiver 22, the user can select a particular time at which to transmit the signal to the wireless headset 24 causing the wireless headset to enter a reduced power mode or to shut down altogether.

In one example, the user can sit down to the various television programs on the television 34. The user expects to be done watching television by 1 AM. In particular, the user expects either to have fallen asleep while watching television or to have gone to bed by 1 AM. The user therefore accesses the menu screens of the television receiver 22 and designates 1 AM as a time after which the wireless headset should enter a low power mode and/or the audio portion of the media programs should no longer be transmitted to the wireless headset 24 from the television receiver 22. Therefore, at 1 AM the television receiver 22 transmits a signal to the wireless headset 24 causing wireless headset 24 to enter the low power or shutdown state. The television receiver 22 can also turn off or cease transmitting the audio portion of the media program to the wireless headset 24.

In one embodiment, the sensor 28 of the wireless headset 24 monitors a physical state of the user such as head motion, head orientation, pulse, breathing rate etc. to detect when the user has fallen asleep. If the sensor 28 detects that the user 30 has fallen asleep, then the sensor 28 can cause the wireless headset 24 to enter a low power mode by shutting down the transceiver 26 or a particular portion of the transceiver 26. The sensor 28 can also cause the entire wireless headset 24 to shut down.

In one embodiment, the television receiver 22 includes a sensor 29, to monitor a physical state of the user 30 such as whether the user's eyes are open. If the sensor 29 detects that the user has fallen asleep, then the television receiver 22 can transmit a signal to the wireless headset 24 causing the wireless headset 24 to enter a low power or shutdown mode.

The media device 36 can be a game console, a DVD player, stereo system or other electronic media device that plays media programs that include an audio portion. The media device 36 transmits the audio portion of the media program to the wireless headset 24. The television receiver 22 can be configured to cause the media device 36 to shut down at a particular time or after a particular program has selected by the user 30. The television receiver 22 can also cause the media device 36 to stop transmitting an audio portion of the media program to the wireless headset 24 at the particular time or after the particular media program has ended. Alternatively, the media device 36 can include functionality allowing the user to select a particular time to cease transmission of the audio portion to the wireless headset 24 or to send a signal to the wireless headset 24 causing the wireless headset 24 to enter the low power or shutdown mode as described previously. Those of skill in the art will recognize that many configurations of the electronic device 36 and television receiver 22 are possible in light of the present disclosure. All such other configurations of the electronic device 36 and television receiver 22 fall within the scope of the present disclosure.

Figure 3:
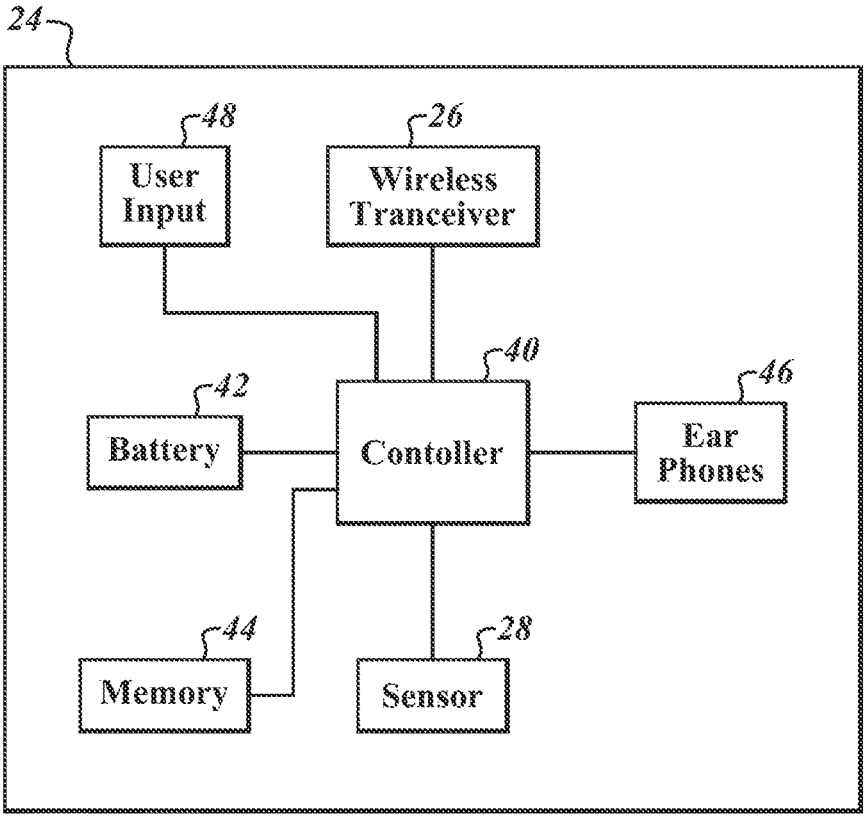
FIG. 3 is a block diagram of a wireless headset according to one embodiment.

FIG. 3 is a block diagram of a wireless headset 24 according to one embodiment. The wireless headset 24 includes a controller 40. The controller 40 is coupled to a battery 42. The controller 40 is further coupled to a memory 44, earphones 46, user input keys 48, wireless transceiver 26, and the sensor 28.

The memory 44 can include one or more of an EEPROM, ROM, SRAM, DRAM, flash RAM, or other types of memory devices. The controller 40 executes instructions stored in the memory 44 to perform the functions of the wireless headset 24.

The wireless transceiver 26 includes one or more wireless transmitters and receivers by which the wireless headset 24 communicates with other devices. The controller 40 controls the wireless transceiver 26. The wireless transceiver 26 receives the audio portion of the media program from a television receiver 22 or other media device 36 as described previously. In one embodiment, the wireless transceiver 26 includes IR and RF transmitters and receivers including a Bluetooth transceiver that receives the audio portion of the media program from the television receiver 22 or other media device 36. The wireless transceiver 26 can also transmit signals to the television receiver 22 and other electronic media devices 36 indicating that the user 30 has fallen asleep. In this way the wireless transceiver 26 can cause the television receiver 22 or other electronic media devices 36 to pause or record the media program, to enter a low power mode, etc., as described previously.

The earphones 46 include speakers that output the audio portion of the media program as an audible sound to the user 30. In particular, the earphones 46 fit on or inside the ears of the user 30 and output sound to the user 30 received via the wireless transceiver 26.

The user input keys 48 are the inputs by which a user 30 can control the wireless headset 24. User input keys 48 can include on, off, and standby keys, volume control keys, wireless transceiver control keys or any other keys suitable for allowing the user 30 to interact with and control the wireless headset 24.

The user inputs 48 can also be on the remote control for the television receiver 22. The remote control can send signals to the television receiver which will store the program for the headset 24 and then output signals to control it.

The sensor 28 monitors the physical state of the user. The sensor 28 can detect whether the user 30 has fallen asleep based on the physical state monitored by the sensor 28. The sensor 28 can include one or more accelerometers, gyroscopes, microphones, pulse rate monitors, breathing monitors, cameras, or any other suitable device for detecting whether the user 30 has fallen asleep. The controller 40 controls the sensor 28 and receives signals from the sensor 28 indicating the physical state of the user 30. In one embodiment, the controller 40 detects whether or not the user has fallen asleep based on comparing the signals received from the sensor 28 to data stored in the memory 44. If the controller 40 determines that the user has fallen asleep, the controller 40 can cause the wireless transceiver 26 to output a signal to the television receiver 22, the television 34, or any other electronic media devices 36. The controller 40 can shut down the wireless transceiver 26 or a portion of the wireless transceiver 26 based on instructions stored in the memory 44. The controller 40 can also cause the entire wireless headset 24 to shut down. In this way, the sensor 28 and the controller 40 can preserve the life of the battery 42 by shutting down one or more portions of the wireless headset 24 when the sensor 28 indicates that the user 30 has fallen asleep. The controller 40 can also cause the wireless transceiver 26 or other components of the wireless headset 24 to wake up and resume full functionality when the sensor 28 indicates that the user has woken up.

Those of skill in the art will understand that the wireless headset 24 can include many more or fewer components than those disclosed in the block diagram of FIG. 3 depending on the particular specification and design of the wireless headset 24 in accordance with principles of the present disclosure. All other configurations of the wireless headset 24 fall within the scope of the present disclosure.

Figure 4:
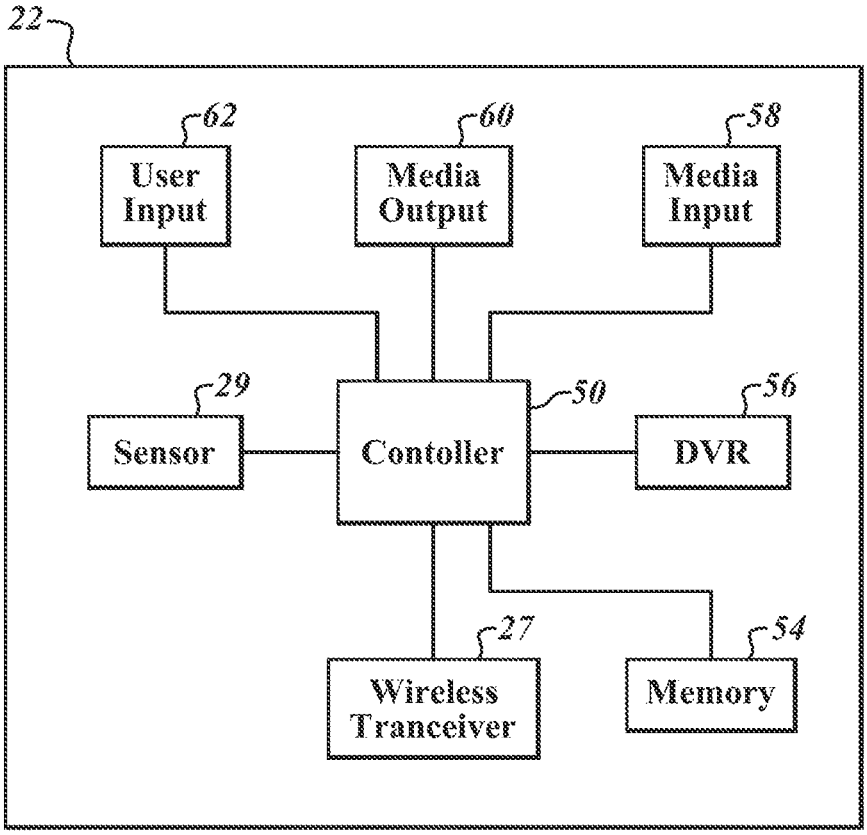
FIG. 4 is a block diagram of a television receiver according to one embodiment.

FIG. 4 is a block diagram of a television receiver 22 according to one embodiment. The television receiver 22 includes a controller 50 coupled to a media input 58. Controller 50 is also coupled to a media output 60, user input 62, sensor 29, a wireless transceiver 27, a memory 54, and a DVR 56.

The media input 58 receives media program data or signals from a satellite television provider, cable television provider, terrestrial broadcast signals, other electronic media devices coupled to the television receiver 22, or any other suitable source of media programs. The media input 58 is controlled by the controller 50.

The media output 60 outputs media programs to a display 34 or other electronic media devices coupled to the television receiver 22 either by a wired connection or a wireless connection. For example, when the television receiver 22 receives a media program from a content provider via the media input 58, the controller 50 processes the input media program and outputs the video portion of the media program to the display 34 via the media output 60.

The digital video recorder (DVR 56) records media programs selected by the user and stores them in memory. In one embodiment, when the television receiver 22 receives a signal from the wireless headset 24 indicating that the user has fallen asleep, the controller 50 causes the DVR 56 to record the remaining portion of the media program currently being viewed.

The memory 54 stores data and software instructions for execution by the controller 50. In particular, the controller 50 controls the various components of the television receiver 22 in accordance with instructions stored in the memory 54 and input received from the user 30.

The wireless transceiver 27 includes one or more wireless receivers and transmitters. The wireless transceiver 27 can include one or more infrared receivers and transmitters, one or more RF receivers and transmitters, a Bluetooth transceiver, etc. In one embodiment, the wireless transceiver 27 transmits to the headset 24 a signal causing the wireless headset 24 to enter a low power or shutdown mode as described previously. The wireless transceiver 27 can also transmit signals to the television 34 or the other electronic media devices 36 causing them to enter a low power or shutdown mode as described previously. The wireless transceiver 27 also receives signals from the remote control 32 by which the user controls the television receiver 22.

The user input 62 can include one or more keys, buttons or other input controls on the face of the television receiver 22. The user input 62 can include keys for allowing the user 30 to manually turn off the television receiver 22, to change the channel of the television receiver 22, or to perform other common input commands for controlling a television receiver 22.

The sensor 29 monitors a physical state of the user 30 while the user is wearing the wireless headset 24. As described previously, if the sensor 29 detects that the user 30 has fallen asleep while viewing a media program the television receiver 22 outputs a signal to the wireless headset 24 causing the wireless headset 24 to enter a low power or shutdown mode. In one embodiment, the sensor 29 includes one or more cameras that track the movements of the user's eyes or head to determine if the user is asleep. The cameras can also detect if the user's eyes are opened and closed. The television receiver 22 can determine if the user is asleep based on the sensor 29 as described previously.

Figure 5A:
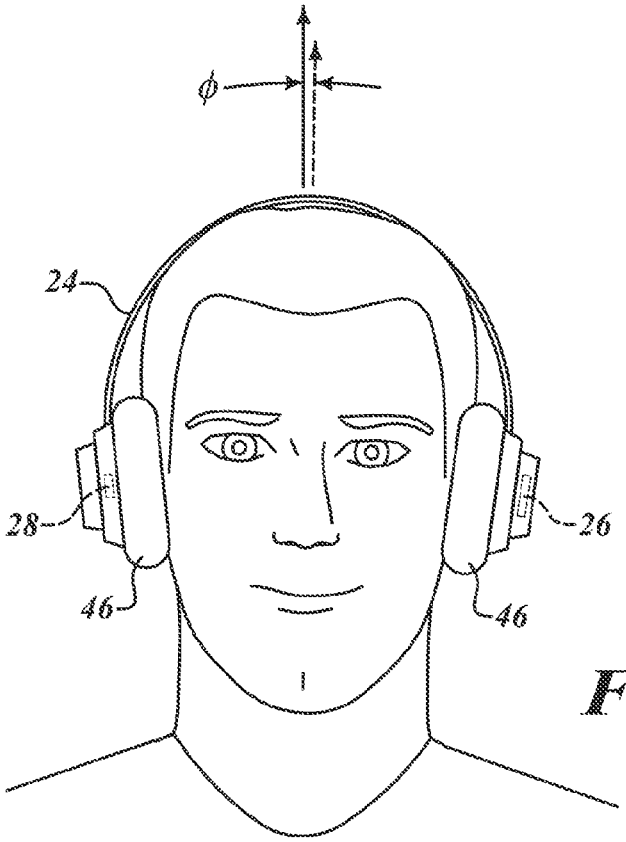
FIG. 5A is an illustration of user wearing a wireless headset while awake according to one embodiment.

FIG. 5A is an illustration of the user 30 wearing a wireless headset 24 while viewing a media program. The wireless headset 24 receives the audio portion of the program as described previously. The audio portion of the program is provided to the user 30 via the headphones 46 of the television receiver 24. The wireless headset 24 includes a transceiver 26 by which the wireless headset 24 receives the audio portion of the media program. The wireless headset 24 further includes sensor 28 which detects the movements and orientation of the users head.

In one embodiment, the sensor 28 includes one or more accelerometers and/or gyroscopes that detect the orientation of the users head. In FIG. 5A the user's head is oriented at a small angle theta with respect to vertical. Sensor 28 monitors the angle the users head with respect to vertical. While the users head is upright and oriented at a small angle theta with respect to vertical, the sensor 28 detects that the user is awake.

Figure 5B:
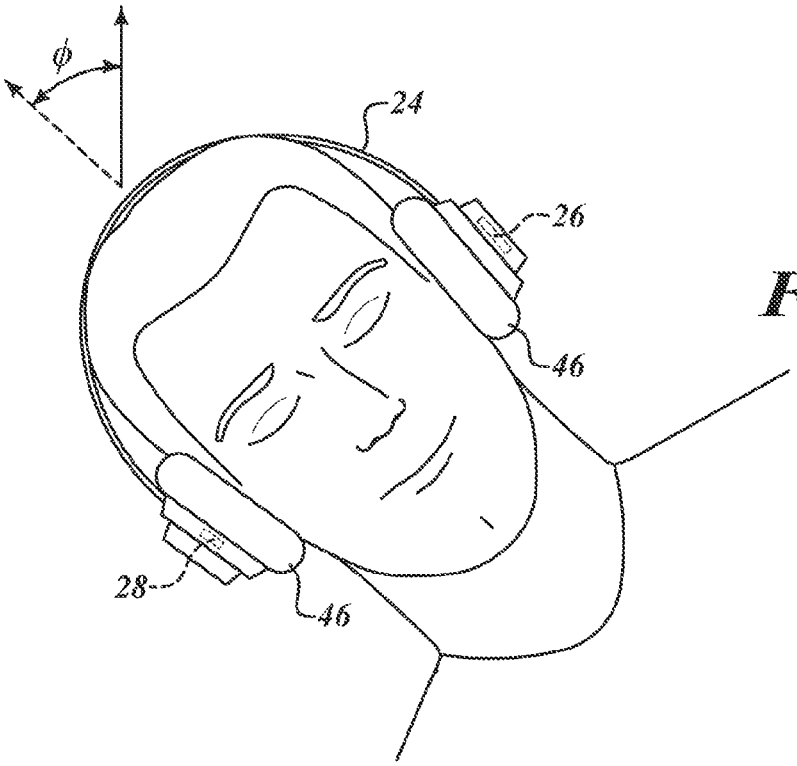
FIG. 5B is an illustration of a user wearing a wireless headset while asleep according to one embodiment.

In FIG. 5B, the user has fallen asleep while watching the media program. Wirelessly, the user's position has shifted such that the users head now makes a much larger angle theta with respect to vertical. In one embodiment, if the sensor 28 of the wireless headset 24 detects that the user's head is oriented with an angle theta that is larger than a threshold angle for a period of time exceeding a threshold time, the sensor 28 determines that the user has fallen asleep. In one example, the threshold angle is 30° with respect to vertical and the threshold time is five minutes. Other suitable values for the threshold angle and threshold time can be chosen as will be recognized by those of skill in the art in light of the present disclosure. In determining whether the user has fallen asleep, the sensor 28 can take into account whether the user's head is leaning back, to the side, etc.

In one embodiment, the sensor 28 monitors the movements of the users head. While a user is awake, the user's head will typically make small movements from time to time such as briefly looking away from the television 34, nodding, jostling due to laughter, etc. When the sensor 28 detects such characteristics head movements, the sensor 28 determines that the user is still awake. However, when the user has fallen asleep, the users head will typically not move at all for relatively long periods of time. If the sensor 28 determines that the users head has not move significantly for a duration of time greater than a threshold period of time, the sensor 28 determines that the user has fallen asleep. Sensor 28 causes the transceiver 26 to power down as described previously.

The sensor 28 can be utilized in many ways to determine if the user has fallen asleep. The sensor 28 can determine whether the user has fallen asleep based on a combination of head orientation and head movements or other factors as will be apparent to those of skill in the art in light of the present disclosure. All such ways of determining whether the user has fallen asleep fall within the scope of the present disclosure.

Figure 6:
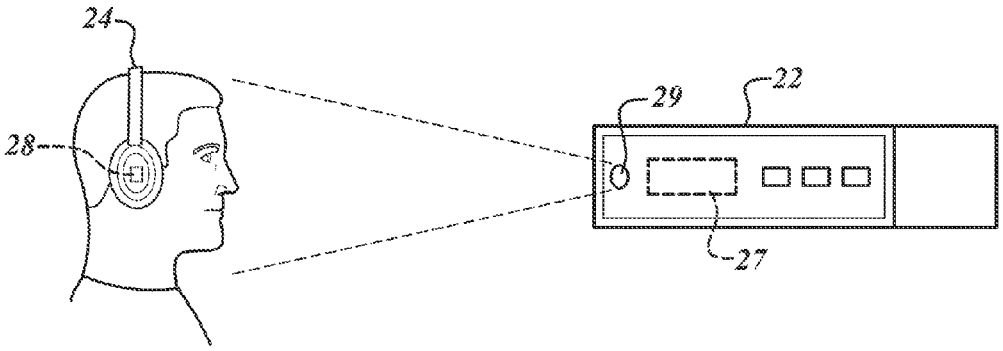
FIG. 6 is an illustration of a television receiver monitoring a user wearing a wireless headset according to one embodiment.

FIG. 6 is an illustration of a user 30 viewing a media program while wearing a wireless headset 24. The television receiver 22 is monitoring the user via a sensor 29 to detect if the user has fallen asleep. In the illustration of FIG. 6 the television receiver is shown as being directly in front of the user and at a level with the users head. In practice, the television receiver 22 may not be directly in front of the user but will be above, below, or to the side of a television 34 on which the user is viewing the media program.

In one embodiment the sensor 29 includes one or more cameras that monitor the user's eyes. The camera can monitor the user's eyes to determine if the user is awake or asleep. If the sensor 29 detects that the user's eyes are closed for a period of time longer than a threshold period of time, the sensor 29 determines that the user has fallen asleep and transmits the power down command to the wireless headset 24 as described previously.

Alternatively, the sensor 29 can monitor the orientation and/or movements of the users head. As described previously, the orientation and movements of the users head provide an indication of whether the user is awake or sleep. If the sensor 29 determines that the user has fallen asleep based on the movements and/or orientation of the users head, the television receiver 22 transmits the power down command to the wireless headset 24 as described previously.

In one embodiment, the sensor 29 is a video camera that detects when the user is wearing the wireless headset 24. If the video camera 29 indicates that the user is not wearing the wireless headset 24, then the television receiver 22 can transmit a command to power down the wireless headset 24. In a similar manner, if the video camera indicates that the user has put on the wireless headset 24, then the television receiver 22 can transmit a command to turn on the wireless headset 24. Alternatively, the sensor 29 can be a camera that periodically takes a picture. The television receiver 22 then analyzes the picture to determine whether or not the wireless headset is being worn by the user and powers down or powers on the wireless headset 24 accordingly.

Figure 7:
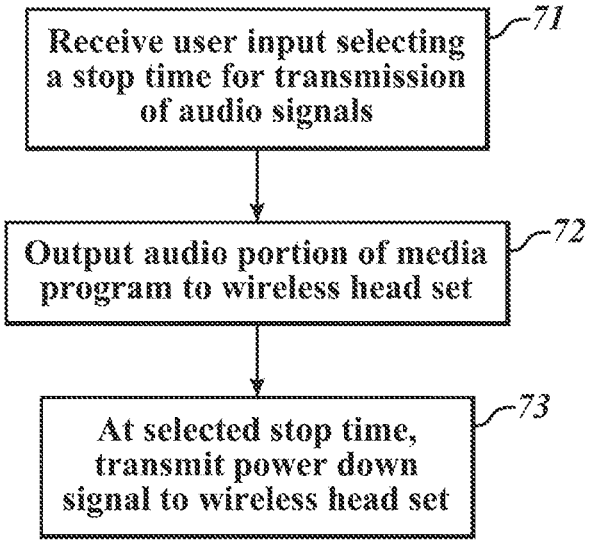
FIG. 7 is a flowchart illustrating a method for preserving batteries in a wireless headset according to one embodiment.

FIG. 7 is a flowchart of a process for preserving batteries in a wireless headset 24 worn by a user while viewing a media program as described previously. At 71 the user inputs via a remote control 32 commands to a television receiver 22 indicating that at the end of a particular program or at a particular time, the television receiver 22 should send a power down signal to the wireless headset 24 in order to preserve the battery life of the wireless headset 24 in case the user falls asleep while wearing the wireless headset 24 or forgets to turn off the wireless headset 24.

At 72, the television receiver 22 outputs to the wireless headset 24 the audio portion of a media program that the user is viewing on the display coupled to the television receiver 22. At 73, the selected program ends or the selected stop time arrives and the television receiver 22 transmits a power down signal to the wireless headset 24. When the wireless headset 24 receives the power down signal, the wireless headset 24 turns off wireless transceiver 26 or shuts down altogether.

Figure 8:
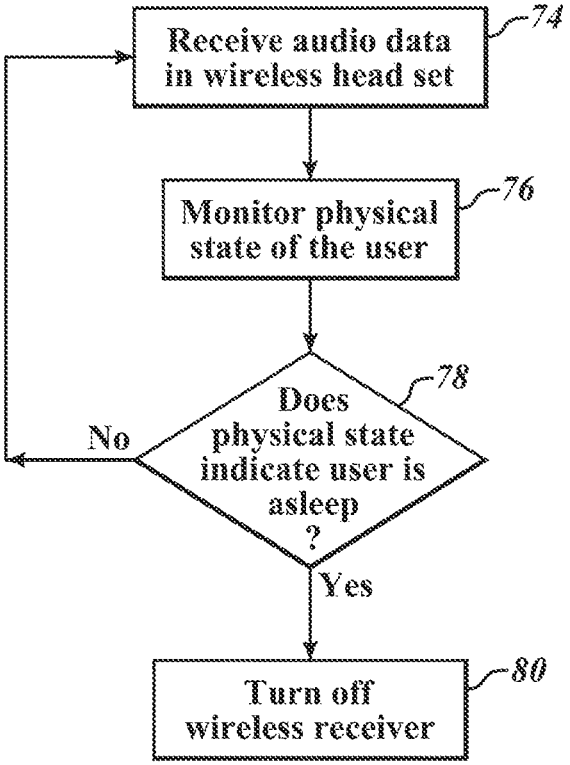
FIG. 8 is a flowchart illustrating a method for preserving batteries in a wireless headset according to one embodiment.

FIG. 8 is a flowchart of a process for preserving batteries in a wireless headset 24 according to an alternative embodiment. At 74, the wireless headset receives the audio portion of a media program from a television receiver 22. At 76, sensor 28 and/or 29 monitors a physical state of the user. The sensor 28 and/or 29 can be housed in the television receiver 22 or in the wireless headset 24 as described previously. At 78, if the sensor 28 and/or 29 detects that the user has not fallen asleep, the wireless headset 24 continues to receive the audio portion of the media program. If the sensor 28 and/or 29 detects that the user has fallen asleep then at 80 the transceiver 26 of the wireless headset 24 is powered down.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method, comprising:

receiving, in a media device, audio data and video data of a media program;

storing the audio data and video data of the media program in a buffer;

powering a wireless headset with a battery positioned within a housing of the wireless headset;

broadcasting, from the media device, an audio portion and a video portion of the media program;

receiving, from the media device, in the wireless headset worn by a user, an audio portion of the media program;

monitoring, in a sensor, a physical state of the user;

detecting, in the sensor, that the user has fallen asleep based on the physical state;

turning off a wireless receiver of the headset in response to detecting that the user has fallen asleep;

transmitting a first signal from the wireless headset to the media device in response to the wireless headset detecting that the user has fallen asleep; and recording the media program in its entirety, including going back and recording the media program from its beginning using the audio data and video data of the selected media program stored in the buffer, in response to the media device receiving the first signal transmitted from the wireless headset in response to the wireless headset detecting that the user has fallen asleep;

transmitting a second signal from the wireless headset to a device coupled to the media device in response to the wireless headset detecting that the user has fallen asleep; and turning off the device coupled to the media device in response to the device coupled to the media device receiving the second signal transmitted from the wireless headset in response to the wireless headset detecting that the user has fallen asleep.

2. The method of claim 1 wherein the sensor is an inertial sensor coupled to the wireless headset.

3. The method of claim 2, comprising determining that the user has fallen asleep based on movements of the user's head detected by the inertial sensor.

4. The method of claim 3, comprising detecting that the user has fallen asleep if the headset has a particular orientation for a period of time longer than a threshold time.

5. The method of claim 2 wherein monitoring the physical state of the user comprises detecting, based on the output of the inertial sensor, an orientation of the headset.

6. The method of claim 5 wherein the orientation indicates that the user's head is no longer upright.

7. The method of claim 1 wherein the sensor includes a microphone and monitoring the physical state comprises monitoring the user's breathing using the microphone.

8. The method of claim 1 wherein monitoring the physical state comprises monitoring whether eyes of the user are shut.

9. The method of claim 1 wherein monitoring the physical state comprises monitoring a heart rate of the user.

10. The method of claim 1, comprising outputting a prompt on a display indicating that the media device will be powered down unless a user input is received in response to detecting that the user has fallen asleep.

11. The method of claim 1, comprising turning off the media receiver in response to receiving the signal in the media receiver.

12. The method of claim 10, comprising turning off a television coupled to the media receiver in response to receiving the signal in the media receiver.

13. The method of claim 1, comprising turning the wireless receiver back on in response to detecting that the user has woken up.

14. The method of claim 1 wherein modifying the output of the media device includes pausing the media program.

15. A method, comprising:

receiving, in a television receiver, audio data and video data of a selected media program;

storing the audio data and video data of the selected media program in a buffer;

transmitting the audio data of the selected media program from the television receiver to a wireless headset;

receiving, in the television receiver, a user input selecting a condition for transmitting a power-down signal to the wireless headset;

transmitting the power-down signal to the wireless headset and a device coupled to the television receiver; and recording the selected media program in its entirety, including going back and recording the media program from its beginning using the audio data and video data of the selected media program stored in the buffer, upon fulfillment of the condition for transmitting the power-down signal to the wireless headset.

16. The method of claim 15, comprising outputting a prompt on a display indicating that the television receiver will be powered down unless another user input is received.

17. The method of claim 15 wherein the condition is a particular time of day.

18. A wireless headset, comprising:

a wireless receiver configured to receive from a media device an audio portion of a media program;

a speaker configured to output the audio portion to a user of the wireless headset;

a sensor configured to monitor a physical state of the user and to output a sensor signal indicative of the physical state;

a controller coupled to the wireless receiver, the speaker, and the sensor and configured to receive the sensor signal and to turn off the wireless receiver when the sensor signal indicates that the user has fallen asleep; and a transmitter coupled to the controller and configured to transmit a first signal from the wireless headset to the media device and a second signal from the wireless headset to a device coupled to the media device in response to the sensor signal indicating that the user has fallen asleep, the first signal being configured to cause the media device to record the media program in its entirety, and the second signal being configured to cause the device coupled to the media device to turn off.

19. The wireless headset of claim 18 wherein the sensor is an inertial sensor configured to monitor an orientation of the headset.

20. The wireless headset of claim 19 wherein the controller is configured to turn off the wireless receiver when the sensor signal indicates that the user's head has not been upright for a period of time longer than a threshold time.

* * * * *